US008770431B1

(12) United States Patent
Glaser et al.

(10) Patent No.: US 8,770,431 B1
(45) Date of Patent: Jul. 8, 2014

(54) SAUCE TRAY AND LID SYSTEM FOR FOOD CONTAINER

(71) Applicant: KFC Corporation, Louisville, KY (US)

(72) Inventors: Paul Glaser, Floyds Knobs, IN (US); Susan E. Miles, Georgetown, IN (US); Rodney T. Stephenson, Leesburg, FL (US); Chris Roeder, Collierville, TN (US)

(73) Assignee: KFC Corporation, Louisville, KY (US)

( * ) Notice: Subject to any disclaimer, the term of this patent is extended or adjusted under 35 U.S.C. 154(b) by 0 days.

(21) Appl. No.: 13/826,294

(22) Filed: Mar. 14, 2013

(51) Int. Cl.
*B65D 51/16* (2006.01)
*A47G 23/00* (2006.01)

(52) U.S. Cl.
CPC ..... *A47G 23/00* (2013.01)
USPC ..... 220/521

(58) Field of Classification Search
CPC ..... A47G 19/00; A47G 19/32; A47G 23/06; B65D 51/16; B65D 51/18; B65D 1/34; B65D 1/36
USPC ..... 206/514, 501, 522; 220/521, 522, 523, 220/23.86, 212, 4.27, 574
See application file for complete search history.

(56) References Cited

U.S. PATENT DOCUMENTS

| | | | | | |
|---|---|---|---|---|---|
| RE17,232 | E | * | 3/1929 | Fitzgerald | 220/8 |
| 1,768,976 | A | * | 7/1930 | Cuthbertson | 220/575 |
| 1,832,585 | A | * | 11/1931 | Sample | 206/103 |
| 2,903,127 | A | * | 9/1959 | Dorman | 206/338 |
| 3,521,788 | A | | 7/1970 | Kandel et al. | |
| 3,739,976 | A | | 6/1973 | MacDaniel | |
| 3,908,877 | A | * | 9/1975 | Kosisky | 294/143 |
| 4,091,953 | A | * | 5/1978 | Daenen | 220/23.86 |
| 4,375,862 | A | | 3/1983 | Kurinsky et al. | |
| 4,506,784 | A | | 3/1985 | Kanfer | |
| 5,372,827 | A | * | 12/1994 | Brauner et al. | 426/106 |
| 5,386,922 | A | * | 2/1995 | Jordan | 220/23.83 |
| 5,540,334 | A | * | 7/1996 | Haas et al. | 206/563 |
| 5,547,098 | A | * | 8/1996 | Jordan | 220/23.86 |
| 5,674,546 | A | | 10/1997 | Barnes et al. | |
| 5,722,558 | A | * | 3/1998 | Thompson | 220/521 |
| 5,871,116 | A | * | 2/1999 | Picchietti | 220/501 |
| 5,890,648 | A | | 4/1999 | Cai | |
| 5,894,953 | A | | 4/1999 | Ramirez | |
| 5,938,060 | A | * | 8/1999 | Rutland, Jr. | 220/23.6 |
| 6,062,418 | A | * | 5/2000 | Rathjen | 220/574 |
| 6,085,926 | A | * | 7/2000 | Weiss | 220/23.86 |
| 6,209,748 | B1 | * | 4/2001 | Dunbar | 220/521 |
| 6,478,183 | B1 | | 11/2002 | Bacon et al. | |
| 6,604,646 | B2 | | 8/2003 | Torniainen et al. | |

(Continued)

FOREIGN PATENT DOCUMENTS

| | | |
|---|---|---|
| GB | 2297536 A | 8/1996 |
| GB | 2331060 A | 5/1999 |

*Primary Examiner* — Steven A. Reynolds
*Assistant Examiner* — King M Chu
(74) *Attorney, Agent, or Firm* — Stites & Harbison, PLLC; David W. Nagle, Jr.

(57) ABSTRACT

A sauce tray defines one or more openings through a base surface to receive and retain one or more containers of dipping sauce, and the sauce tray is further configured to be positioned in either a first orientation or second orientation on top of a food container. In some embodiments, the sauce tray is part of a lid system that also creates a separate cavity within the interior volume of the food container to store another food product.

17 Claims, 9 Drawing Sheets

(56) References Cited

U.S. PATENT DOCUMENTS

| | | | | |
|---|---|---|---|---|
| 6,719,192 | B2 | 4/2004 | Barcat et al. | |
| 6,766,902 | B1 * | 7/2004 | Hartelius | 206/217 |
| D520,874 | S | 5/2006 | Gross et al. | |
| D521,382 | S | 5/2006 | Gross et al. | |
| D568,765 | S | 5/2008 | Miles | |
| 7,428,864 | B2 * | 9/2008 | Wengrovsky | 99/646 C |
| 7,806,284 | B2 * | 10/2010 | Mangano | 220/4.27 |
| 7,823,743 | B2 * | 11/2010 | McKahan et al. | 220/521 |
| 7,871,653 | B2 * | 1/2011 | Lin | 426/115 |
| D656,816 | S | 4/2012 | Glaser et al. | |
| 8,146,766 | B2 | 4/2012 | Vovan et al. | |
| 8,201,691 | B1 * | 6/2012 | Chowdhury | 206/534 |
| 2003/0146222 | A1 * | 8/2003 | Loh | 220/575 |
| 2004/0035867 | A1 | 2/2004 | Schultz et al. | |
| 2005/0194383 | A1 * | 9/2005 | House et al. | 220/23.86 |
| 2005/0236413 | A1 * | 10/2005 | Maciag et al. | 220/256.1 |
| 2007/0062965 | A1 * | 3/2007 | Anderson et al. | 220/912 |
| 2008/0023473 | A1 * | 1/2008 | Spyros et al. | 220/23.86 |
| 2008/0105736 | A1 * | 5/2008 | Kalberer | 229/120.38 |
| 2008/0128313 | A1 * | 6/2008 | Anderson et al. | 206/565 |
| 2008/0206437 | A1 * | 8/2008 | Perry | 426/614 |
| 2008/0210686 | A1 * | 9/2008 | Shapiro et al. | 219/735 |
| 2009/0092738 | A1 * | 4/2009 | Shew et al. | 426/665 |
| 2009/0120942 | A1 | 5/2009 | Vovan | |
| 2009/0200195 | A1 | 8/2009 | Kovacevich et al. | |
| 2010/0181226 | A1 * | 7/2010 | Kovacevich et al. | 206/562 |
| 2010/0230419 | A1 * | 9/2010 | Joseph | 220/574 |
| 2011/0114643 | A1 | 5/2011 | Bogdziewicz | |
| 2012/0000923 | A1 * | 1/2012 | Powell | 220/780 |
| 2012/0255959 | A1 * | 10/2012 | Cai et al. | 220/592.2 |
| 2012/0311972 | A1 * | 12/2012 | Hunter | 53/471 |

* cited by examiner

SAUCE TRAY AND LID SYSTEM FOR FOOD CONTAINER

BACKGROUND OF THE INVENTION

The present invention relates to food packaging, and, more particularly, to a sauce tray and a lid system for a food container.

In the quick service restaurant industry, a wide variety of packaging is used for food products. Furthermore, in the quick service restaurant industry, a wide variety of condiments and dipping sauces are often served with the food products and also require some form of packaging. For example, several types of storage containers for condiments and dipping sauces are commonly used. For condiments such as ketchup, mustard, and mayonnaise, perhaps the most common and well-known containers are the pillow-shaped packets that are made of a flexible plastic and are opened by tearing the packet along a selected edge. For dipping sauces, however, it is more common to store such sauces in a small plastic container with a flexible plastic or foil lid that can be pulled off of the container; leaving an open top for dipping another food product into the sauce. In any event, in most cases, such condiments and dipping sauces are simply thrown into a bag with the primary food products.

SUMMARY OF THE INVENTION

The present invention is a sauce tray and a lid system for a food container. The sauce tray defines one or more openings through a base surface to receive and retain one or more containers of dipping sauce, and the sauce tray is further configured to be positioned in either a first orientation or second orientation on top of the food container. In some embodiments, the sauce tray is part of a lid system that also creates a separate cavity within the interior volume of the food container to store another food product.

An exemplary lid system made in accordance with the present invention includes three components: an insert tray; a paperboard insert; and a sauce tray. In one configuration, the insert tray is configured to be received in an upper portion of a food container. The insert tray has a bottom wall and a continuous side wall that collectively define an interior cavity with an open top. Accordingly, the insert tray effectively functions as a bowl. The insert tray further includes an upper circumferential flange, so that insert tray can be received in the food container, with the upper circumferential flange engaging the rim of the food container. Such placement of the insert tray within the food container creates a separate cavity within the interior volume of the food container to store another food product. Then, the paperboard insert is sized and shaped such that it can be used as a lid to close access to this separate cavity.

In a second configuration, the sauce tray can be placed over the insert tray on top of the food container. In this second configuration, the sauce tray is in a first orientation and effectively forms a dome over the insert tray. Thus, a cavity is created between the base surface of the sauce tray and the insert tray. The sauce tray includes one or more openings through its base surface (or floor), and each of these openings is sized and shaped to receive and retain a container of dipping sauce.

In a third configuration, the exemplary sauce tray can be inverted into a second orientation and then positioned directly on top of the food container. Thus, rather than forming a dome, the sauce tray forms a bowl that encroaches into the interior volume of the food container. Although now inverted into the second orientation, the sauce tray still functions in the same manner, with each of the one or more openings configured to receive and retain a container of dipping sauce.

DETAILED DESCRIPTION OF THE INVENTION

The present invention is a sauce tray and a lid system for a food container. The sauce tray defines one or more openings through a base surface to receive and retain one or more containers of dipping sauce, and the sauce tray is further configured to be positioned in either a first orientation or second orientation on top of the food container. In some embodiments, the sauce tray is part of a lid system that also creates a separate cavity within the interior volume of the food container to store another food product.

Figure 1:
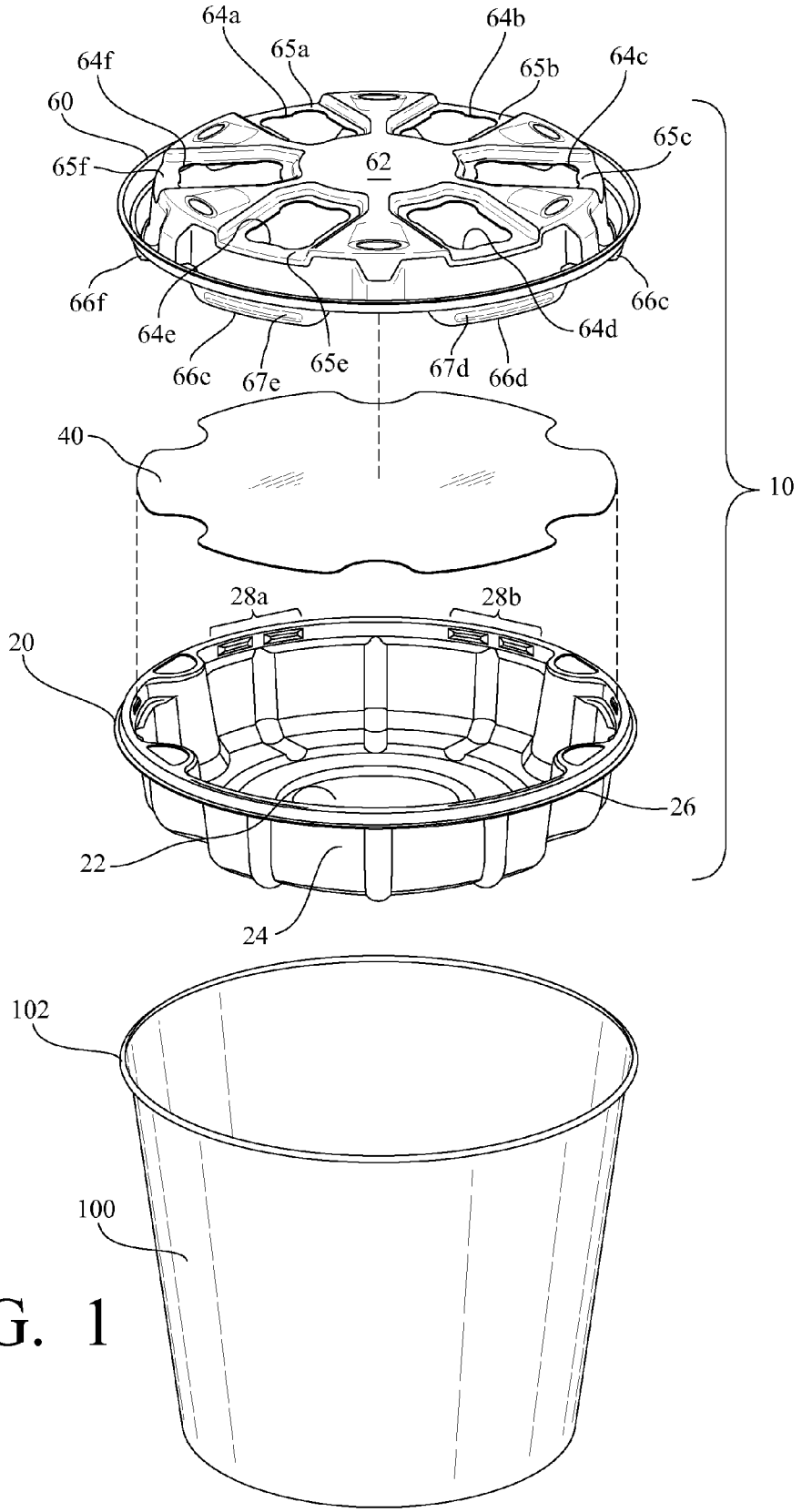
FIG. 1 is an exploded perspective view of an exemplary lid system made in accordance with the present invention.

Referring first to FIG. 1, an exemplary lid system 10 made in accordance with the present invention includes three components: an insert tray 20; a paperboard insert 40; and a sauce tray 60. However, all three components are generally not used simultaneously; rather, the sauce tray 60 is preferably used alone or in combination with either the insert tray 20 or the paperboard insert 40, as further described below.

Figure 2:
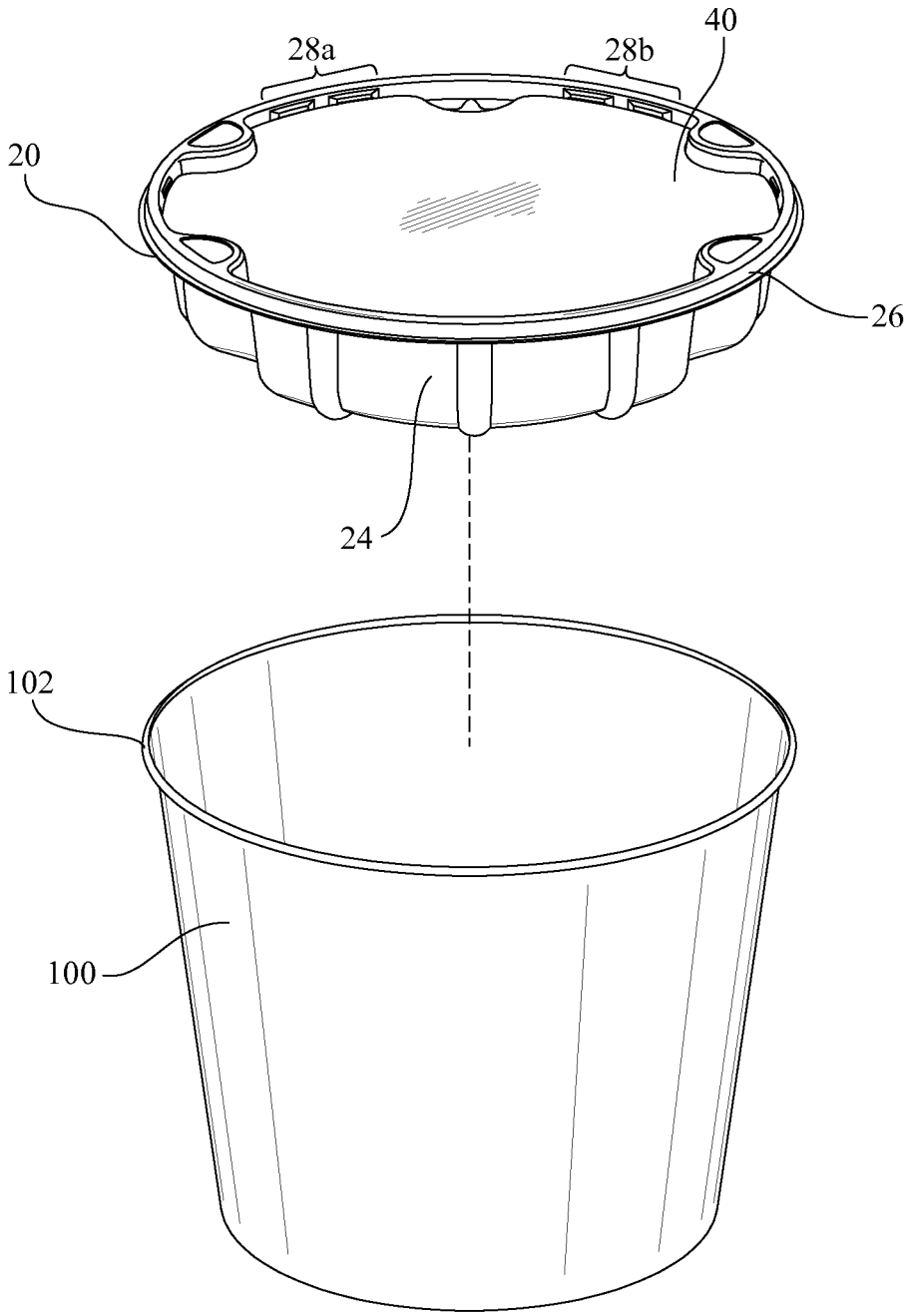
FIG. 2 is a perspective view of the exemplary lid system of FIG. 1, in which the insert tray and the paperboard insert have been assembled together.
Figure 3:
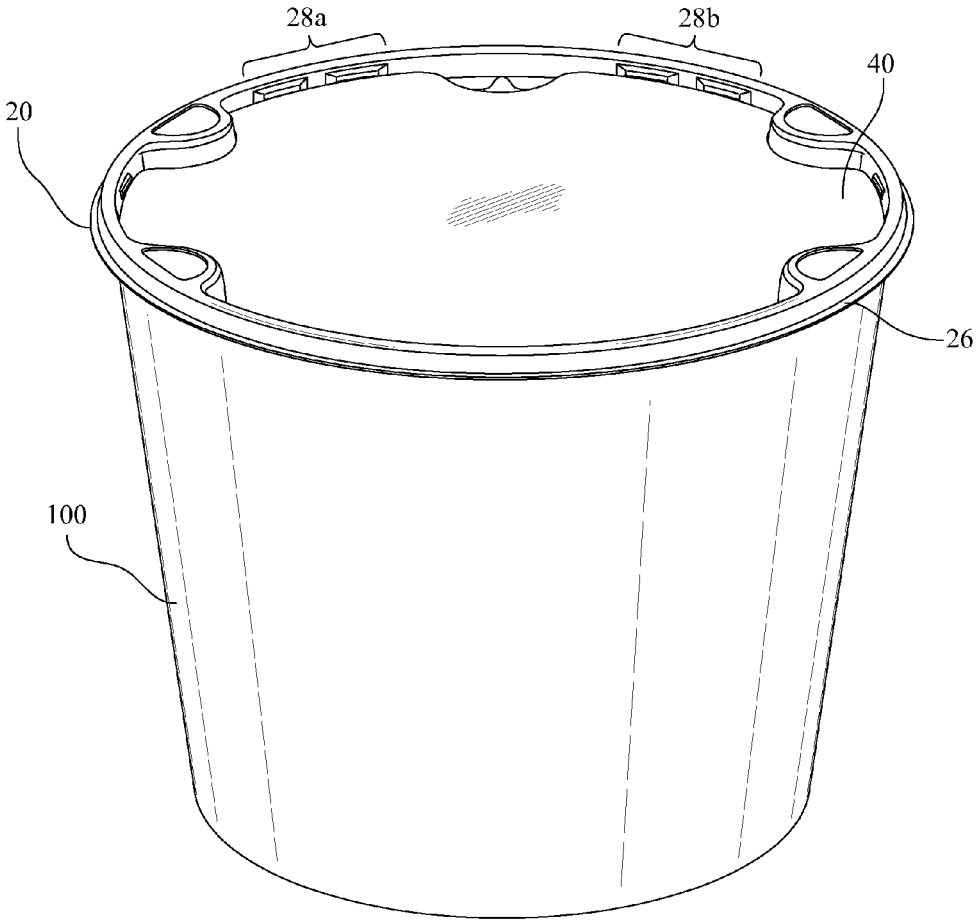
FIG. 3 is a perspective view of the exemplary lid system of FIG. 1, in which the insert tray and the paperboard insert are assembled together and received in a food container.

Referring still to FIG. 1, along with FIGS. 2 and 3, in one configuration, the insert tray 20 is configured to be received in an upper portion of a food container 100, such as the paperboard bucket that is commonly used by the assignee of the present invention, KFC Corporation of Louisville, Ky., to distribute its chicken products. In this regard, the insert tray 20 has a bottom wall 22 and a continuous side wall 24 that collectively define an interior cavity with an open top. Accordingly, the insert tray 20 effectively functions as a bowl. The insert tray 20 further includes an upper circumferential flange 26, so that the insert tray 20 can be received in the food container 100, with the upper circumferential flange 26 engaging the rim 102 of the food container 100. In this example, because the food container 100 (or bucket) has a circular rim 102, the insert tray 20 has a corresponding circular circumferential flange 26; however, both the food container 100 and the insert tray 20 could have non-circular shapes without departing from the spirit and scope of the present invention. In any event, such placement of the insert tray 20 within the food container 100 creates a separate cavity within the interior volume of the food container 100 to store another food product. Then, as also shown in FIGS. 1-3, the paperboard insert 40 is sized and shaped such that it can be used as a lid to close access to this separate cavity. In this regard, the paperboard insert 40, which is substantially flat, rests on a series of internal ledges defined within the interior cavity of the insert tray 20, and thus, the paperboard insert 40 has a geometry that corresponds to that of the upper portion of the insert tray 20.

Figure 4:
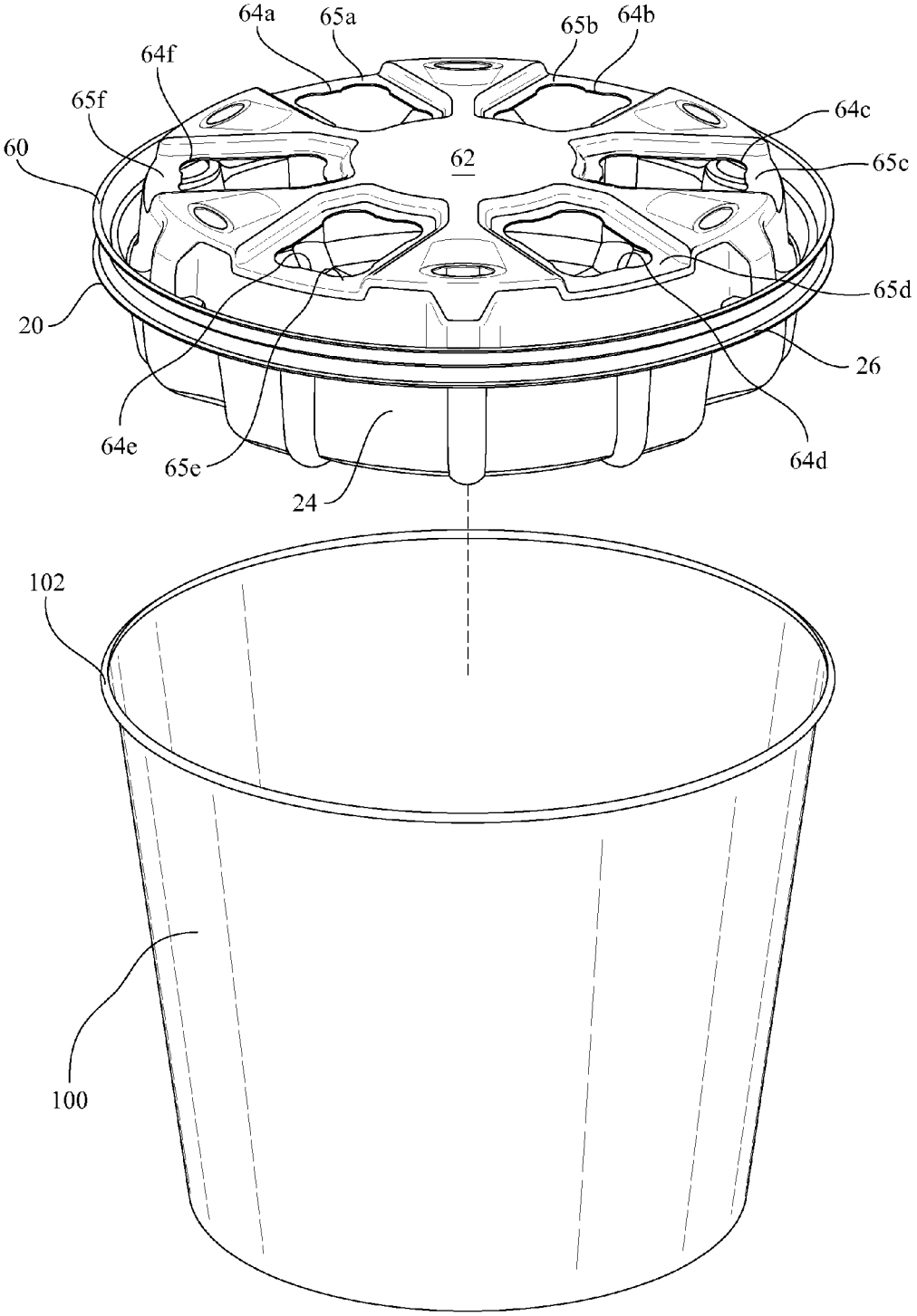
FIG. 4 is a perspective view of the exemplary lid system of FIG. 1, in which the insert tray and the sauce tray have been assembled together.
Figure 4A:
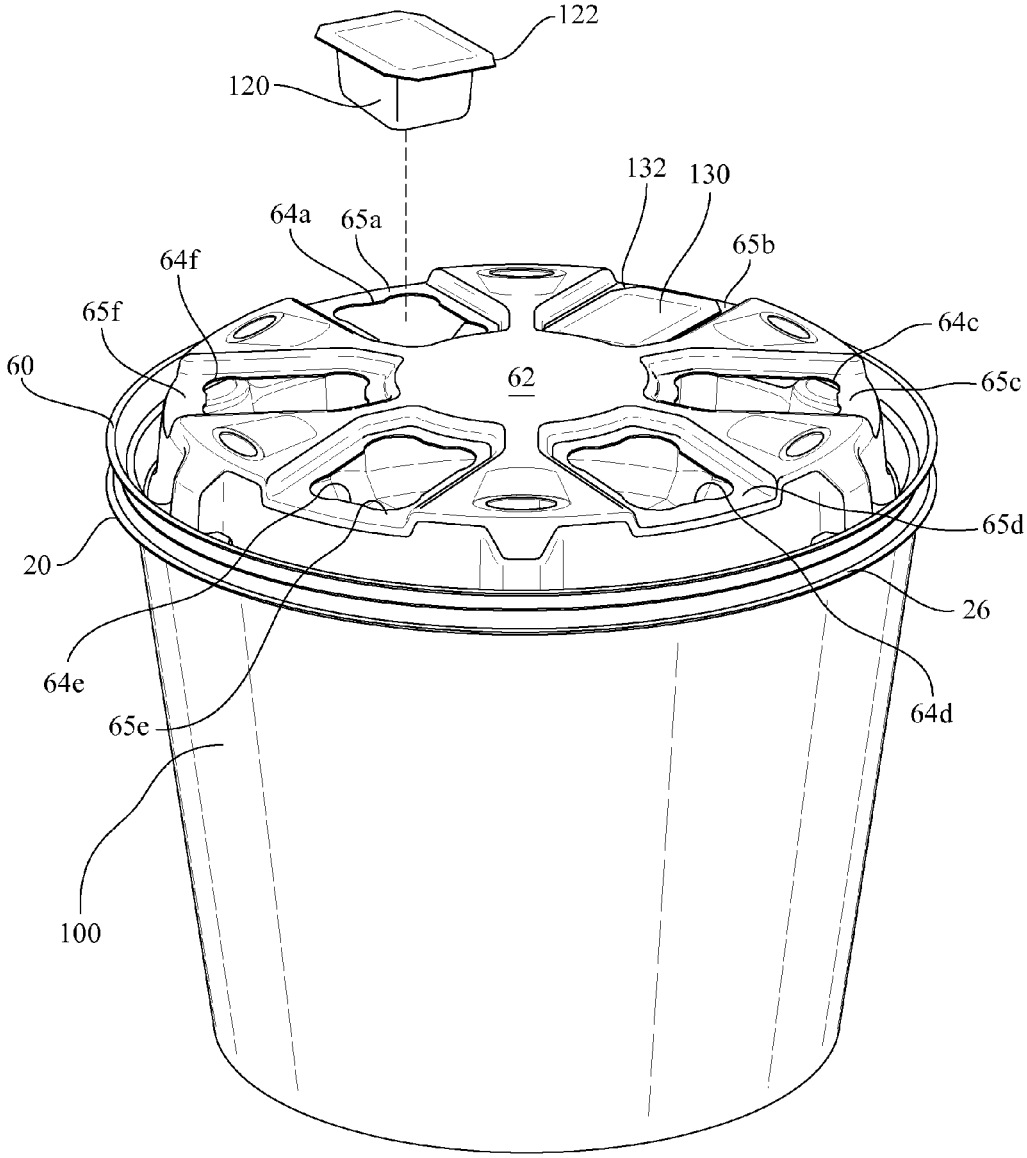
FIG. 4A is a perspective view of the exemplary lid system of FIG. 1, in which the insert tray and the sauce tray have been assembled together and received in a food container.
Figure 7:
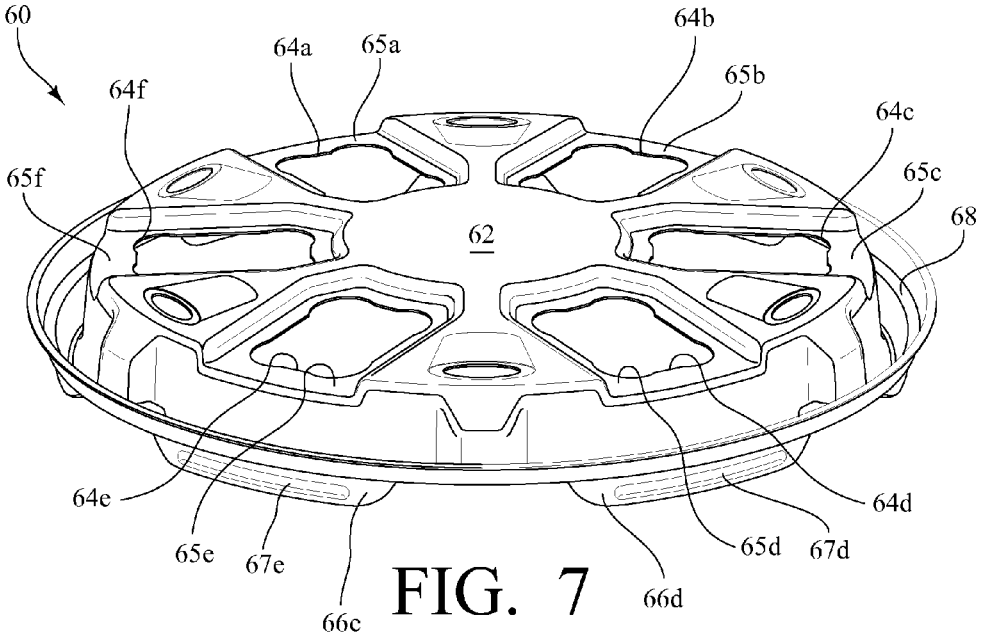
FIG. 7 is a perspective view of the exemplary sauce tray of FIG. 5 in a first orientation.
Figure 9:
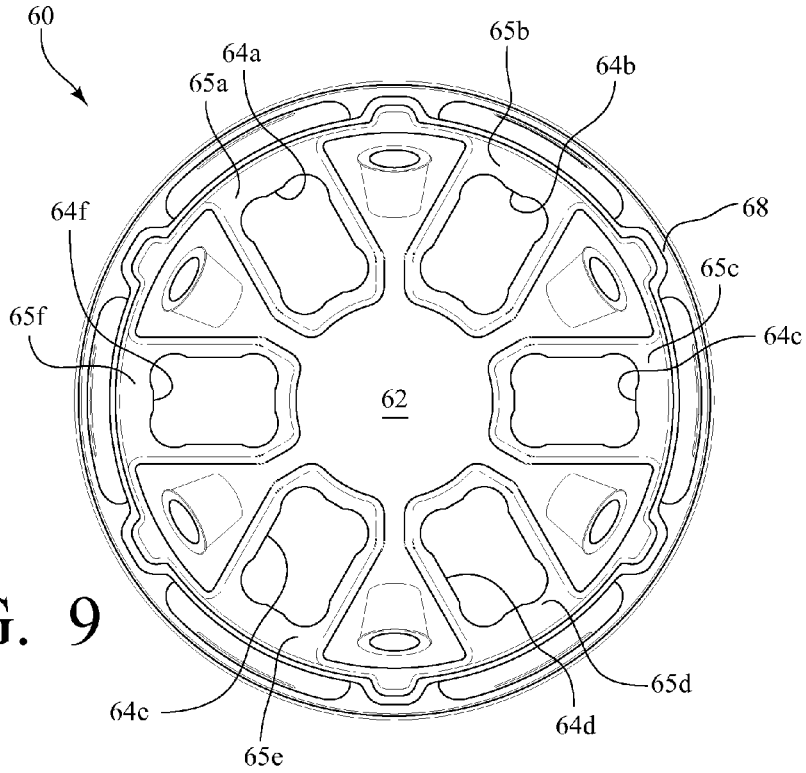
FIG. 9 is a plan view of the exemplary sauce tray of FIG. 7.

Referring now to FIGS. 4 and 4A, in a second configuration, the sauce tray 60 can be placed over the insert tray 20 on top of the food container 100; the paperboard insert 40 is not used. In this second configuration, the sauce tray 60 is in a first orientation (as also depicted in FIGS. 7 and 9) and effectively forms a dome over the insert tray 20. Thus, a cavity is created between the insert tray 20 and the base surface 62 of the sauce tray 60. As shown, the sauce tray 60 includes multiple openings through its base surface 62 (or floor). In this exemplary embodiment, there are six such openings 64*a-f*, and each of these openings 64*a-f* is sized and shaped to receive and retain a container of dipping sauce. In this exemplary embodiment, it is contemplated that the containers of dipping sauce each have a generally rectangular shape, and so the openings 64*a-f* have a corresponding rectangular shape. Of course, other sizes and shapes of containers could be accommodated by varying the size and shape of the openings 64*a-f* without departing from the spirit and scope of the present invention.

For purposes of example, two such containers 120, 130 of dipping sauce are shown in FIG. 4A. Such containers 120, 130 of dipping sauce commonly have an upper flange 122, 132 to which the flexible plastic or foil lid is secured. The upper flange 122, 132 of each container 120, 130 of dipping sauce engages the sauce tray 60 so that the containers 120, 130 of dipping sauce do not fall through the sauce tray 60. Indeed, in this embodiment and as shown in FIG. 4A, a recessed area 65*a-f* is formed in the sauce tray 60 around the periphery of each of the six openings 64*a-f* to better accommodate the respective flanges of 122, 132 of the containers 120, 130 of dipping sauce.

Thus, in the second configuration, and referring still to FIGS. 4 and 4A, the placement of the insert tray 20 within the food container creates a separate cavity within the interior volume of the food container 100 to store another food product. Once the sauce tray 60 is positioned over the insert tray 20, a second cavity is effectively created within the "dome" defined by the sauce tray 60. Multiple containers of dipping sauce can then be supported by the sauce tray 60, each such container of dipping sauce extending into this second cavity.

As a further refinement, the insert tray 20 and the sauce tray 60 may be provided with a means for locking the two components together in the second configuration. Perhaps as best shown in FIGS. 1 and 7, in this exemplary embodiment, the sauce tray 60 includes six downwardly extending appendages 66*a-f*, two of which are visible and identified by reference numbers 66*d*, 66*e* in FIGS. 1 and 7. These downwardly extending appendages 66*a-f* are spaced at intervals around the periphery of the sauce tray 60. Of course, fewer or more appendages could be used without departing from the spirit and scope of the present invention. Each of these appendages 66*a-f* defines a lateral recess 67*a-f*, two of which are visible and identified by reference numbers 67*d*, 67*e* in FIGS. 1 and 7. The insert tray 20 includes multiple tabs that are adapted to engage the lateral recesses 67*a-f* defined by the downwardly extending appendages 66*a-f* of the sauce tray 60. In this exemplary embodiment, the sauce tray 60 includes six pairs of such tabs that are spaced at intervals around the periphery of the insert tray 20, with two such pairs of tabs visible and identified by reference numbers 28*a*, 28*b* in FIGS. 1-3. Each such pair of tabs can be received in a respective recess. In any event, once the sauce tray 60 is positioned over the insert tray 20 in this second configuration, the insert tray 20 and the sauce tray 60 can be effectively locked together through engagement of the multiple tabs of the insert tray 20 (including tabs 28*a*, 28*b*) with the lateral recesses (including recesses 67*d*, 67*e*) defined by the downwardly extending appendages (including 66*d*, 66*e*) of the sauce tray 60.

Finally, with respect to this second configuration, the paperboard insert 40 is not used in the exemplary embodiment described above. However, it is contemplated that some form of paperboard insert or similar divider could be incorporated into and used in this second configuration to separate the cavity defined by the insert tray 20 from the second cavity defined by the sauce tray 60 without departing from the spirit and scope of the present invention.

Figure 5:
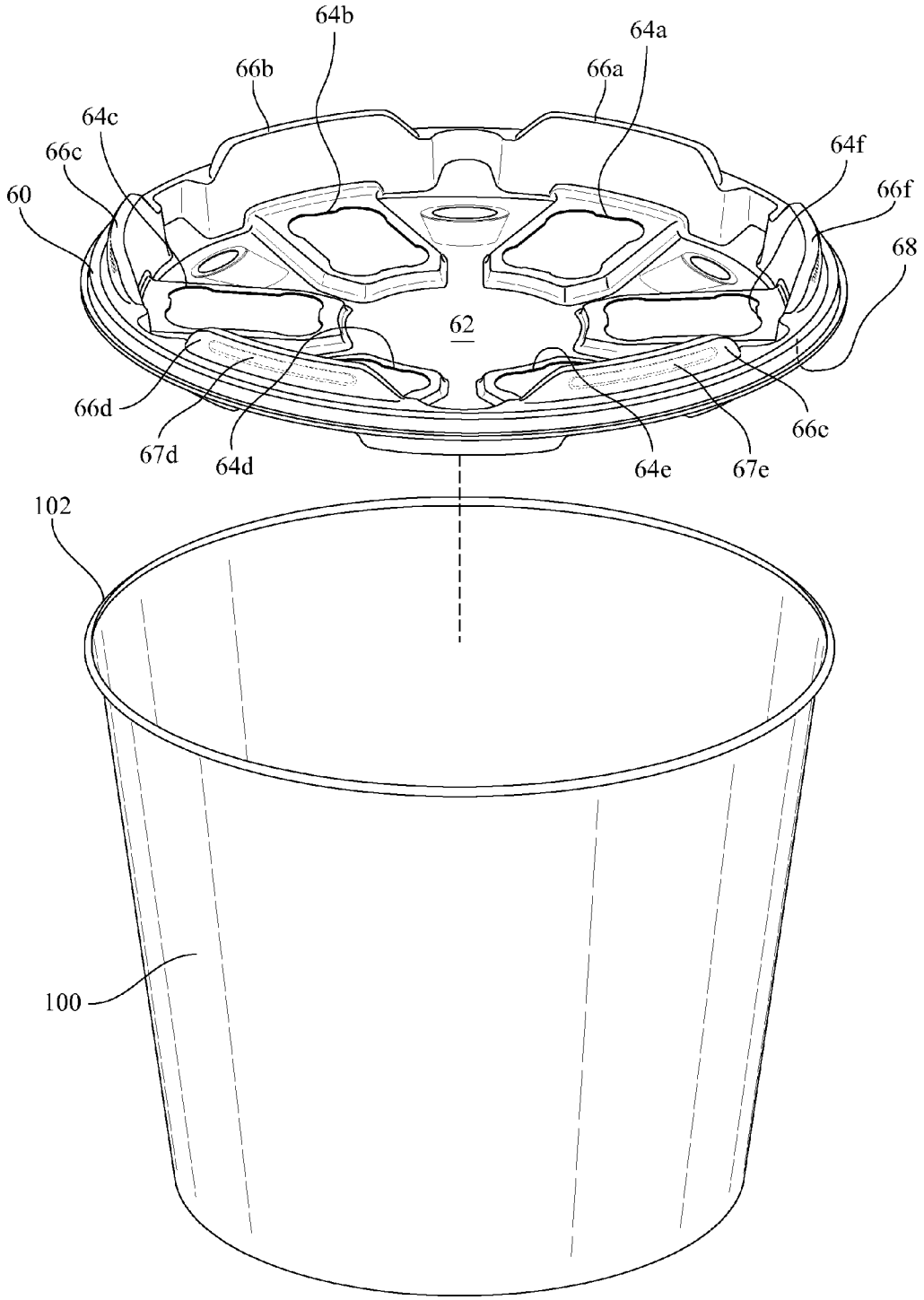
FIG. 5 is a perspective view of an exemplary sauce tray made in accordance with the present invention in an alternate (or second) orientation relative to a food container.
Figure 6:
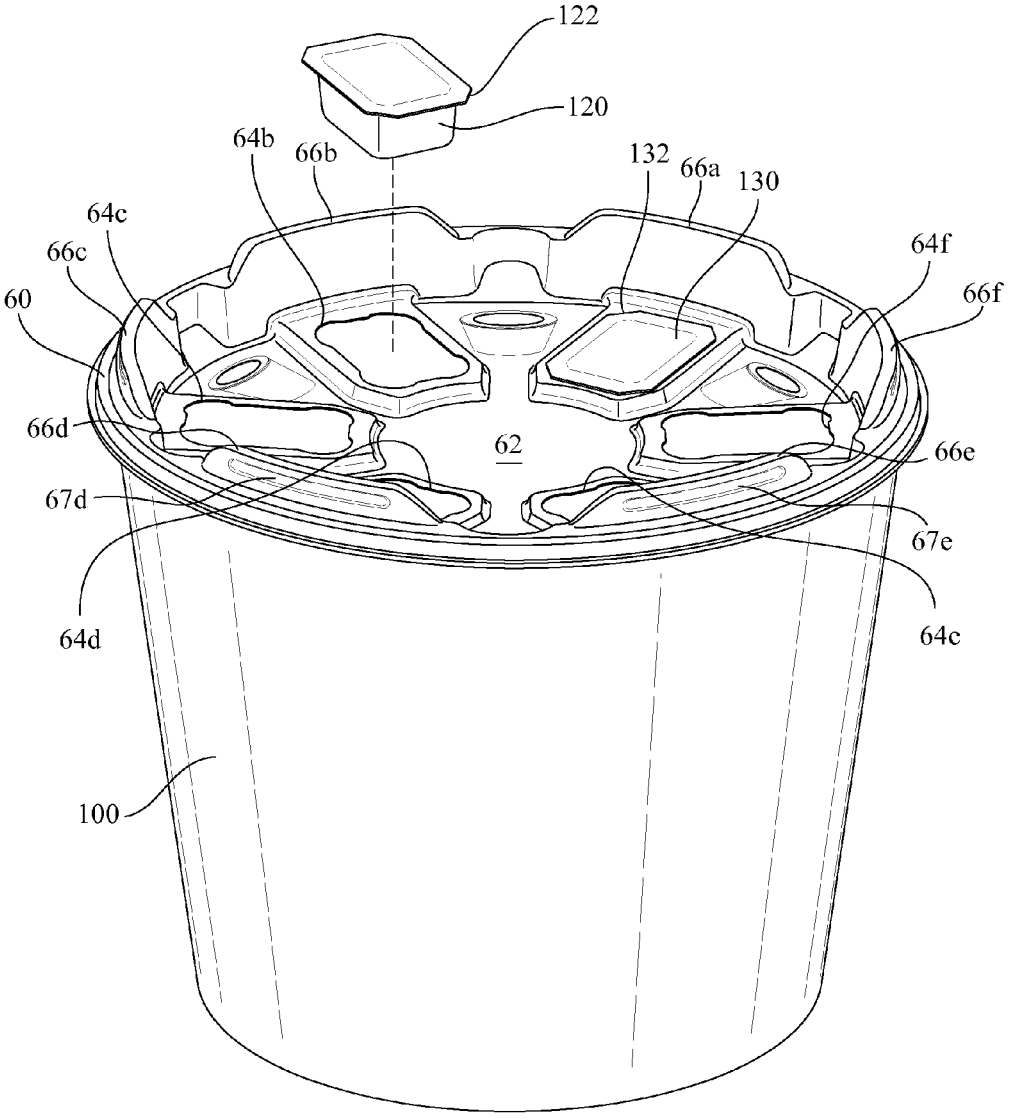
FIG. 6 is a perspective view of the exemplary sauce tray of FIG. 5 received in a food container in the alternate (or second) orientation.
Figure 8:
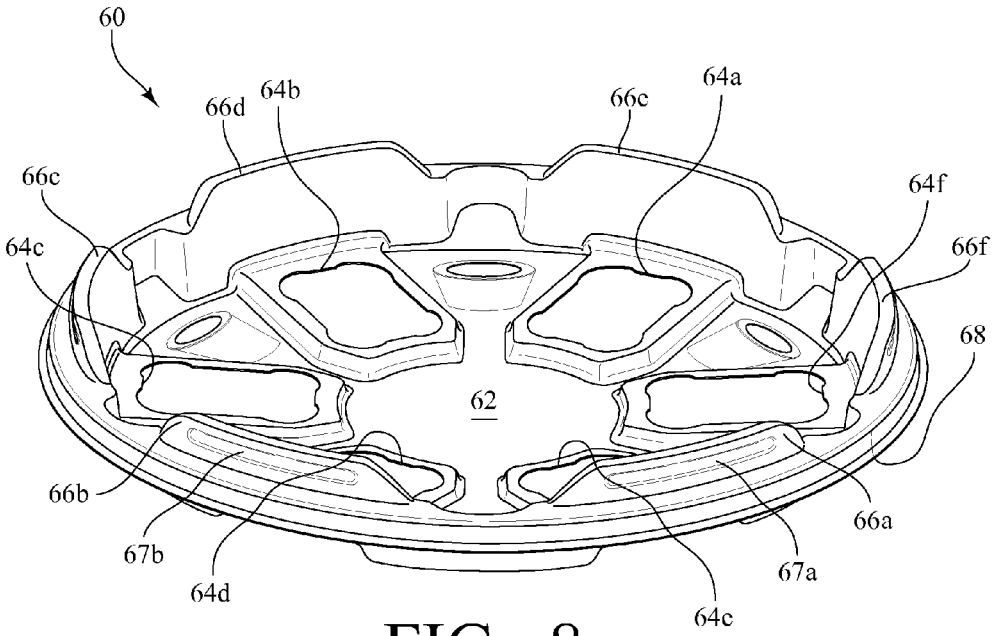
FIG. 8 is a perspective view of the exemplary sauce tray of FIG. 5 in the alternate (or second) orientation.
Figure 10:
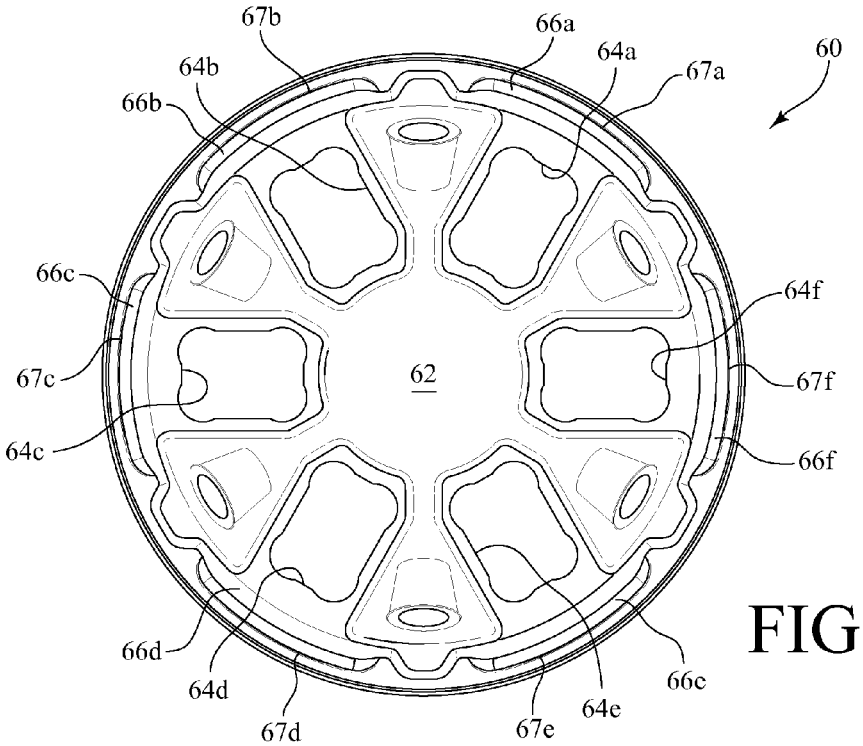
FIG. 10 is a plan view of the exemplary sauce tray of FIG. 8.

Referring now to FIGS. 5 and 6, in a third configuration, the exemplary sauce tray 60 can be inverted into a second orientation (as also depicted in FIGS. 8 and 10) and then positioned directly on top of the food container 100. Thus, rather than forming a dome as in FIGS. 4, 4A, 7 and 9 (described above), the sauce tray 60 forms a bowl that encroaches into the interior volume of the food container 100. In this exemplary embodiment, the sauce tray 60 defines a circumferential groove 68 that engages the rim 102 of the food container 100. Although now inverted into the second orientation, the sauce tray 60 still functions in the same manner, with each of the multiple openings 64*a-f* configured to receive and retain a container of dipping sauce. For purposes of example, in FIG. 6, two such containers 120, 130 of dipping sauce are shown. Again, such containers 120, 130 of dipping sauce commonly have an upper flange 122, 132 to which the flexible plastic or foil lid is secured. The upper flange 122, 132 of each container 120, 130 of dipping sauce engages the sauce tray 60 so that the containers 120, 130 of dipping sauce do not fall through the sauce tray 60.

One of ordinary skill in the art will recognize that additional embodiments are possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A combination, comprising:

a food container; and a sauce tray defining multiple openings through a base surface and configured to be positioned in either a first orientation or second orientation on top of the food container, wherein (a) in the first orientation, the sauce tray effectively forms a dome over the food container, (b) in the second orientation, the sauce tray effectively forms a bowl that encroaches into an interior volume of the food container, and (c) in both the first orientation and the second orientation, the sauce tray is configured to receive and retain a container of dipping sauce through each of the multiple openings through the base surface of the sauce tray, with an upper flange of the container of dipping sauce engaging the base surface of sauce tray.

2. The combination as recited in claim 1, wherein the sauce tray defines a circumferential groove that engages a rim of the food container when the sauce tray is in the second orientation.

3. The combination as recited in claim 2, wherein the rim of the food container has a circular shape, and the circumferential groove defined by the sauce tray has a corresponding circular shape.

4. A lid system for a food container, comprising:

an insert tray having a bottom wall and a continuous side wall that collectively define an interior cavity with an open top, said insert tray being received in an upper portion of the food container, thus creating a separate cavity within an interior volume of the food container; and a sauce tray, said sauce tray defining one or more openings through a base surface, and said sauce tray being placed over the insert tray on top of the food container, wherein the sauce tray is configured to receive and retain one or more containers of dipping sauce through the one or more openings through the base surface of the sauce tray;

wherein the sauce tray includes multiple downwardly extending appendages that are spaced at intervals around a periphery of the sauce tray with each of these downwardly extending appendages defining a lateral recess, and wherein the insert tray includes multiple tabs that are adapted to engage the lateral recesses defined by the downwardly extending appendages of the sauce tray, thus locking the sauce tray to the insert tray.

5. The lid system as recited in claim 4, and further comprising a paperboard insert for selectively closing access to the separate cavity created by the insert tray.

6. The lid system as recited in claim 5, wherein the paperboard insert rests on one or more internal ledges defined within the interior cavity of the insert tray.

7. The lid system as recited in claim 4, wherein, the sauce tray effectively forms a dome over the insert tray on top of the food container.

8. The lid system as recited in claim 4, wherein the insert tray includes an upper circumferential flange for engaging a rim of the food container.

9. The lid system as recited in claim 8, wherein the rim of the food container has a circular shape, and the upper circumferential flange of the insert tray has a corresponding circular shape.

10. A combination, comprising:

a food container;

an insert tray having a bottom wall and a continuous side wall that collectively define an interior cavity with an open top, said insert tray being received in an upper portion of the food container, thus creating a separate cavity within an interior volume of the food container; and a sauce tray, said sauce tray defining one or more openings through a base surface, and said sauce tray being placed over the insert tray on top of the food container, wherein the sauce tray is configured to receive and retain one or more containers of dipping sauce through the one or more openings through the base surface of the sauce tray.

11. The combination as recited in claim 10, in which an upper flange of each of the one or more containers of dipping sauce engages the base surface of sauce tray.

12. The combination as recited in claim 10, wherein said sauce tray defines multiple openings through the base surface.

13. The combination as recited in claim 10, wherein the sauce tray effectively forms a dome over the insert tray on top of the food container.

14. The combination as recited in claim 10, wherein the insert tray includes an upper circumferential flange for engaging a rim of the food container.

15. The combination as recited in claim 14, wherein the rim of the food container has a circular shape, and the upper circumferential flange of the insert tray has a corresponding circular shape.

16. The combination as recited in claim 10, and further comprising a means for locking the sauce tray to the insert tray.

17. The combination as recited in claim 10, wherein the sauce tray includes multiple downwardly extending appendages that are spaced at intervals around a periphery of the sauce tray with each of these downwardly extending appendages defining a lateral recess, and wherein the insert tray includes multiple tabs that are adapted to engage the lateral recesses defined by the downwardly extending appendages of the sauce tray, thus locking the sauce tray to the insert tray.

* * * * *